US007770653B2

(12) United States Patent
Hill et al.

(10) Patent No.: US 7,770,653 B2
(45) Date of Patent: Aug. 10, 2010

(54) WELLBORE BYPASS METHOD AND APPARATUS

(75) Inventors: Thomas G. Hill, The Woodlands, TX (US); Jeffrey L. Bolding, Kilgore, TX (US)

(73) Assignee: BJ Services Company U.S.A., Houston, TX (US)

( * ) Notice: Subject to any disclaimer, the term of this patent is extended or adjusted under 35 U.S.C. 154(b) by 376 days.

(21) Appl. No.: 11/916,985

(22) PCT Filed: Jun. 8, 2006

(86) PCT No.: PCT/US2006/022261

§ 371 (c)(1),
(2), (4) Date: Dec. 7, 2007

(87) PCT Pub. No.: WO2006/133350

PCT Pub. Date: Dec. 14, 2006

(65) Prior Publication Data

US 2008/0202770 A1 Aug. 28, 2008

Related U.S. Application Data

(60) Provisional application No. 60/595,137, filed on Jun. 8, 2005.

(51) Int. Cl.
*E21B 19/08* (2006.01)
*E21B 33/068* (2006.01)

(52) U.S. Cl. ..... 166/379; 166/77.2; 166/88.4; 166/90.1; 166/95.1

(58) Field of Classification Search ..... 166/77.1, 166/77.2, 88.4, 90.1, 95.1, 97.1, 379
See application file for complete search history.

(56) References Cited

U.S. PATENT DOCUMENTS

| | | | | |
|---|---|---|---|---|
| 4,268,283 | A | 5/1981 | Roberts | 55/189 |
| 4,972,904 | A | 11/1990 | Godare | 166/77 |
| 5,975,211 | A | 11/1999 | Harris | 166/379 |
| 6,315,046 | B1 | 11/2001 | Jack et al. | 166/312 |
| 6,457,530 | B1 | 10/2002 | Lam et al. | 166/368 |
| 6,851,478 | B2 | 2/2005 | Cornelssen et al. | 166/368 |

OTHER PUBLICATIONS

PCT International Search Report and Written Opinion dated Feb. 5, 2007, corresponding to PCT/US2006/02261, filed Jun. 8, 2006.

*Primary Examiner*—Hoang Dang
(74) *Attorney, Agent, or Firm*—Zarian Midley & Johnson PLLC

(57) ABSTRACT

A valve (136, 136', 136", 200) adapted to replace an existing valve of a wellhead (114). Valve (136, 136', 136", 200) can have similar dimensions as the existing valve it replaces to utilize existing wellhead connections. In one embodiment, a replacement bypass master valve (136) incorporates a fluid bypass pathway (168) to enable communication and conveyance of a production enhancing fluid (132) from a location external to the well through small diameter tubing (126) to a specific downhole location independent the position of a flow control member in interior chamber (166). Replacement bypass master valve (136') can include anchor seal assembly (122') disposed in locking profile 180 of upstream inlet bore (162) to enable communication from fluid bypass pathway (168) to lower injection conduit (128). In another embodiment, replacement valve (200) includes a groove in gate (208) sealingly receiving capillary injection tubing (204) when in a closed position.

23 Claims, 6 Drawing Sheets

WELLBORE BYPASS METHOD AND APPARATUS

CROSS-REFERENCE TO RELATED APPLICATION

This application claims the benefit of provisional application U.S. Ser. No. 60/595,137 filed Jun. 8, 2005.

FIELD OF THE INVENTION

The present invention is related to hydrocarbon producing wells and wellheads, and creates a secure bypass pathway through the wellhead. More specifically, the invention is a valve adapted to replace an existing valve that is a component of a wellhead valve system commonly called a Christmas tree or tree. The valve of the present invention incorporates a port to enable communication and/or conveyance of a production enhancing fluid from a location external to the well through small diameter tubing to a specific downhole location.

BACKGROUND OF THE INVENTION

Hydrocarbon producing wells typically have a casing or liner that is cemented therein, and a production tubing that is suspended from a tubing hanger in a wellhead. An annular packer is located between the casing and the production tubing, forcing fluids from the well to flow inside the production tubing at a certain velocity to the surface. Production from a well is generally multi-phase, wherein gas, oil, water, and/or some suspended solids, such as sand, are carried from a subterranean reservoir to the earth's surface. The ratio of the gas, oil, and/or water produced determines whether the well is considered to be a gas well, oil well, or water well. The velocity of the produced fluids is determined in part by formation pressure, or bottom hole pressure (BHP).

When a well is first drilled, its BHP is at its maximum value, therefore the velocity in the production tubing is at its highest value and the maximum amount of hydrocarbon is lifted from the well. Over time, production causes a depletion of the reservoir, a drop in BHP, and a reduction of velocity in the production tubing. As production tubing velocity decreases, droplets of well fluids can "fall back" down the well. This can lead to water accumulation in the production tubing. As the water accumulation rises in the production tubing, a hydrostatic head pressure develops therein. When the hydrostatic head pressure equals the BHP, hydrocarbon flow from the reservoir ceases.

Additional production problems that are typically encountered include: (i) emulsions can form when certain ratios of the well chemistry exist; (ii) precipitate deposition of dissolved solids can occur which will restrict and/or occlude the tubing; and (iii) corrosion can occur to production tubing due to well chemistry.

Chemical technologies have been developed to mitigate or eliminate these problems. Surfactants are commonly injected to de-water wells, and other chemicals are used to counter emulsions, precipitates, and to provide corrosion protection. One method that is well known in the industry is to deploy these chemicals through spoolable tubing, commonly known as coiled tubing, or preferably small diameter capillary tubing due to its ease of transport and manipulation. One of ordinary skill in the art will immediately appreciate that any type of tubing can be employed to accomplish the same objective. For the sake of descriptive expediency, capillary tubing shall be referenced in this disclosure to describe the use of the invention, however any type of communication conduit can be utilized without departing from the spirit of the invention.

In practice, the capillary tubing is deployed inside the production tubing, and a suitable chemical is injected from the surface through the capillary tubing to a location downhole.

A common problem occurs at the wellhead where the capillary tubing emerges from the wellhead. Typically, the capillary tubing runs through the wellhead valves, into a pressure retaining packoff, thereby emerging from the wellhead. If it becomes necessary to close one of the wellhead valves, the capillary tubing is sheared off, only to later be fished out of the well. Another well known wellhead penetration method is to construct a spool (adapted to fit between wellhead flanges) that has an opening for the capillary tubing to emerge. Unfortunately, the insertion of such a spool can change the overall height of the wellhead and alter locations of flow lines.

U.S. Pat. No. 6,851,478, hereby incorporated by reference, discloses a Y-body Christmas tree for use with coiled tubing and other wellhead components which integrates components of a Christmas tree, while providing for coiled tubing access without necessarily adding to the vertical height of the unit. However, the placement of the Y-section above the lower master valve results in shearing of the capillary tubing when the lower master valve is closed. Additionally, the Y-body Christmas tree does not facilitate retrofitting an existing master valve as the Y-body Christmas tree is a replacement for an entire existing Christmas tree, and can require significant re-piping. Pedcor, Inc., in a product brochure, discloses a chemical injection adapter which provides one mechanism for inserting coil tubing through a well head, with similar drawbacks as described above.

The present invention contemplates the above problems and provides solutions to the foregoing needs.

SUMMARY OF THE INVENTION

The present invention provides an apparatus for use in a production well that allows for use of capillary tubing where the capillary tubing is placed such that the capillary tubing is not damaged and remains operational when the master valve is closed.

The present invention provides an apparatus for use in a production well having a wellhead attached to a production tubing, the apparatus including a body member having an upstream inlet bore, a downstream outlet bore, and an interior chamber, a flow control member disposed in the interior chamber to regulate a fluid flow from the upstream inlet bore to the downstream outlet bore, and a fluid bypass pathway connecting the upstream inlet bore upstream each of any flow control member of the wellhead to a port in the body member to allow fluid communication with the production tubing independent of a position of the any flow control member of the wellhead.

An apparatus can include a first connector attached to the upstream inlet bore to provide fluid communication with a first wellhead component, a second connector attached to the downstream inlet bore to provide fluid communication with a second wellhead component, a third connector attached to the port in the body member to provide fluid communication with a third wellhead component. The first, second, and third connectors can be screwed connections, flanged connections, or the like, and combinations thereof.

The fluid bypass pathway can be oblique to the upstream inlet bore, or can be substantially perpendicular or substantially parallel to the upstream inlet bore. The apparatus can include a tubing guide proximate an intersection of the upstream inlet bore and the fluid bypass pathway.

A communication conduit having an upper end and a distal end can be installed through the fluid bypass pathway. The distal end of the communication conduit can extend into the production tubing. At least one slip can be installed between an interior of the fluid bypass pathway and an exterior of the communication conduit, proximate to the upper end of the communication conduit. Additionally, a packoff can be proximate the upper end of the communication conduit, the packoff sealing the annulus between an interior of the fluid bypass pathway and the exterior of the communication conduit. The communication conduit can be capillary tubing, wireline, slickline, fiber optic cable, coiled tubing, or the like.

A tool, such as a subsurface safety valve, a tubing hanger, or the like, can be connected to the distal end of the communication conduit. An upper end of a lower communication conduit can be connected to a lower portion of the tool. An injection head can be connected to a distal end of the lower communication conduit for the distribution of the fluid flow into the well. The tool can include an interior passage to direct a fluid flow from the interior of the communication conduit to an interior of the lower communication conduit.

A subsurface safety valve disposed in the production tubing can be connected to the distal end of the communications conduit. A lower communication conduit can extend upstream from the subsurface safety valve, the lower communication conduit in fluid communication with the communication conduit through an interior passage of the subsurface safety valve. An injection head can be connected to a distal end of the lower communication conduit.

The upstream inlet bore can include a locking profile intermediate the interior chamber and the fluid bypass pathway. The locking profile can be used to engage a tool, for example, an anchor seal assembly, having a main body providing an engagement profile configured to be retained by the locking profile, an upper seal assembly and a lower seal assembly to seal an interface between the main body and the upstream inlet bore, an inlet port intermediate the upper and lower seal assemblies in fluid communication with the fluid bypass pathway, an outlet port in the main body proximate a lower end of the main body, and a communication channel extending through the main body to provide fluid communication between the inlet port and the outlet port. A lower communication conduit can be in fluid communication with the outlet port. An injection head can be connected to a distal end of the lower communication conduit.

In another embodiment, the invention provides a well with a cased borehole having an upper and a lower end, production tubing disposed therethrough having an upper and a lower end and forming an annulus with the cased borehole wherein the production tubing is sealed at an upper end of the cased borehole. The well includes a wellhead to control a production of fluids from the well comprising at least one valve can include a body member having an upstream inlet bore, a downstream outlet bore, and an interior chamber. A flow control member is disposed in the interior chamber to regulate a fluid flow from the upstream inlet bore to the downstream outlet bore. A fluid bypass pathway connects the upstream inlet bore to a port in the body member.

The well can include a first connector attached to the upstream inlet bore to provide fluid communication with a first wellhead component; a second connector attached to the downstream inlet bore to provide fluid communication with a second wellhead component; a third connector attached to the port in the body member to provide fluid communication with a third wellhead component. The first, second, and third connectors can be screwed connections, flanged connections, or the like, or a combination thereof.

The fluid bypass pathway can be oblique, including perpendicular, to the upstream inlet bore. The valve can include a tubing guide proximate an intersection of the upstream inlet bore and the fluid bypass pathway.

The well can include a communication conduit having an upper end and a distal end installed through the fluid bypass pathway. Slips can be installed between an interior of the fluid bypass pathway and an exterior of the communication conduit, proximate to the upper end of the communication conduit. A packoff can be proximate the upper end of the communication conduit, sealing the annulus between the interior of the fluid bypass pathway and the exterior portion of the communication conduit.

The well can include a tool connected to the distal end of the communication conduit. The well can include a lower communication conduit having an upper end and a distal end, wherein the upper end of the lower communication conduit is connected to a lower portion of the tool. The tool can include an interior passage to direct a fluid flow from the interior of the communication conduit to an interior of the lower communication conduit. The well can also include an injection head connected to the distal end of the lower communication conduit for the distribution of the fluid flow into the well.

The upstream inlet bore of the valve used in the well can include a locking profile intermediate the interior chamber and the fluid bypass pathway for engaging a tool including a main body providing an engagement profile configured to be retained by the locking profile; an upper seal assembly and a lower seal assembly to seal an interface between the main body and the upstream inlet bore; an inlet port intermediate the upper and lower seal assemblies in fluid communication with the fluid bypass pathway; an outlet port proximate a lower end of the main body; a pathway extending through the main body to provide fluid communication from the inlet port to the outlet port.

The lower communication conduit can be in fluid communication with the outlet port. An injection head can be connected to a distal end of the lower communication conduit.

In yet another embodiment, a master valve of a wellhead attached to a production tubing includes a master valve body having an upstream inlet bore, a downstream outlet bore, and an interior chamber, a flow control member disposed in the interior chamber to regulate a fluid flow from the upstream inlet bore to the downstream outlet bore, and a fluid bypass pathway connecting the upstream inlet bore to a port in the master valve body. A capillary tubing having an upper end and a distal end can be installed through the fluid bypass pathway. The distal end of the capillary tubing can extend into the production tubing. The fluid bypass pathway can be capillary tubing.

In another embodiment, an apparatus for use in a production well having a wellhead attached to a production tubing includes a body member having an upstream inlet bore, a downstream outlet bore, and an interior chamber, a gate disposed in the interior chamber to regulate a fluid flow from the upstream inlet bore to the downstream outlet bore, and a capillary tubing passing through the inlet bore, outlet bore, and interior chamber, the gate having a groove sealingly receiving the capillary tubing when the gate is in a closed position to allow operation of the flow control member without disrupting fluid communication within the capillary tubing.

A method to retrofit a wellhead including an original master valve having an axial length, a width, and an internal bore diameter can include removing the original master valve, providing a bypass master valve having a substantially similar axial length, width, and internal bore diameter as the original master valve, replacing the original master valve with the bypass master valve, the bypass master valve including a master valve body having an upstream inlet bore, a downstream outlet bore, and an interior chamber, a flow control member disposed in the interior chamber to regulate a fluid flow from the upstream inlet bore to the downstream outlet bore, and a fluid bypass pathway connecting the upstream inlet bore to a port in the master valve body. The fluid bypass pathway can intersect or otherwise connect to the upstream inlet bore upstream each of any flow control member of the wellhead. The method can include fluidicly communicating with a production tubing attached upstream to the master valve through the fluid bypass pathway when the flow control member is closed. The method can further include inserting an anchor seal assembly into a locking profile in the upstream inlet bore of the bypass master valve, and sealing the anchor seal assembly to the upstream inlet bore with an upper seal assembly and a lower seal assembly, an inlet port in the main body intermediate the upper and lower seal assemblies, the inlet port in fluid communication with the fluid bypass pathway, and a communication channel in fluid communication with the inlet port and an outlet port on a lower end of the anchor seal assembly.

In another embodiment, the invention provides a method to retrofit an existing wellhead including a master valve having an axial length, a width, and an internal bore of a diameter, including removing the master valve, replacing the master valve with the apparatus as described above, where the apparatus can have an approximately identical or otherwise matching axial length, width, and internal bore diameter as that of the master valve. The retrofit method can be used to retrofit a wellhead of an existing well.

In another embodiment, the invention provides a method to retrofit an existing wellhead including a master valve and a flow cross proximate the master valve, which when connected together have an axial length, a width, an internal bore of a diameter, and specified outlet locations (overall dimensions), the method including removing the master valve, removing the flow cross proximate the master valve, and, installing an apparatus for use in the production well having a wellhead attached to the production tubing to replace the master valve and flow cross, wherein the apparatus has approximately identical or similar outer dimensions and outlet locations as the master valve and flow cross when connected.

In another embodiment of the present invention, an apparatus for use in a production well having a wellhead attached to a production tubing, includes a body member having an upstream inlet bore, a downstream outlet bore, and an interior chamber, a flow control member disposed in the interior chamber to regulate a fluid flow from the upstream inlet bore to the downstream outlet bore, and a capillary tubing passing through the inlet bore, outlet bore, and interior chamber, wherein the flow control member can include a gate adapted to surround and form a seal with the capillary tubing, enabling an operation of the flow control member without disrupting communication within the capillary tubing.

BRIEF DESCRIPTION OF THE DRAWINGS

For a more detailed description of the preferred embodiments of the present invention, reference will be made to the accompanying drawings, wherein.

DETAILED DESCRIPTION

Figure 1:
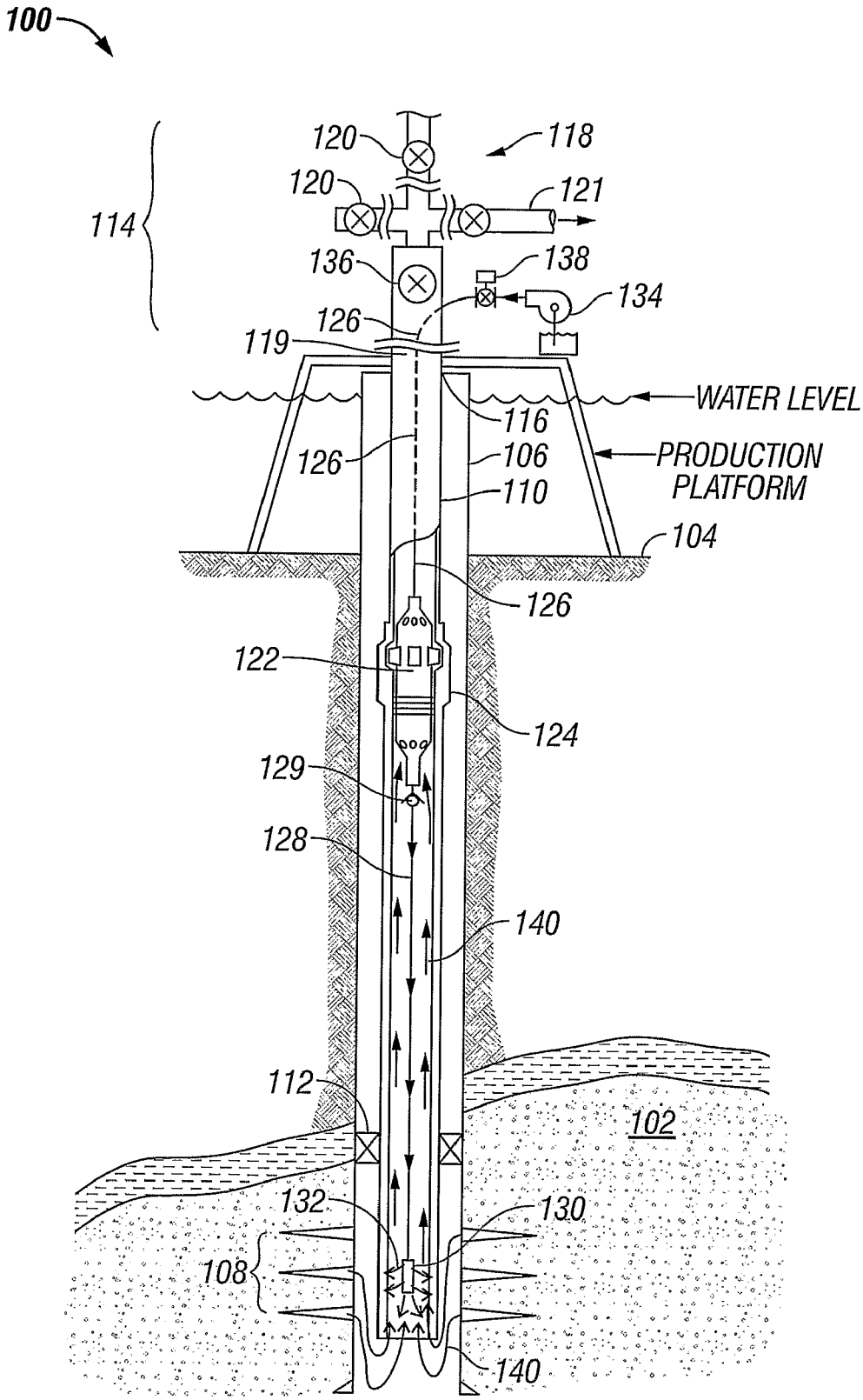
FIG. 1 is a schematic drawing illustrating a simplified offshore well incorporating one embodiment of the present invention.

FIG. 1 illustrates a well production system 100, which can be any type of well, and is shown as an offshore production system for illustrative purposes only. Normally, well production system 100 allows for the recovery of production fluids 140, typically hydrocarbons, from an underground reservoir 102 to a location on or above sea floor 104. To retrieve the production fluids 140, a cased borehole 106 is drilled from the sea floor 104 to reservoir 102. Perforations 108 allow the flow of production fluids 140 from reservoir 102 into cased borehole 106 where reservoir pressure drives the production fluids 140 to the surface through a string of production tubing 110. A packer 112 preferably seals the annulus between production tubing 110 and cased borehole 106 to prevent the pressurized production fluids 140 from escaping through the annulus. A wellhead 114 caps the upper end of the cased borehole 106 and production tubing 110 to prevent annular fluids from escaping into and polluting the environment. Preferably, wellhead 114 provides sealed ports 116 where strings of tubing (e.g., production tubing 110) are allowed to pass through while still maintaining the hydraulic integrity of wellhead 114. Wellhead Christmas tree 118 can be attached to the upper end 119 of production tubing 110, providing valves 120, master valve 136, and a flow line 121 which carries fluids produced from reservoir 102 to a pumping or containment station (not shown).

Elevated pressures of production fluids 140 in production tubing 110 at upper end 119 can be hazardous to downstream components; many safety regulations require the installation of a subsurface safety valve (SSV) 122 below wellhead 114. Subsurface safety valve's and improvements thereto are described in several patent applications incorporated herein by reference, including U.S. Ser. No. 60/522,499, filed Oct. 7, 2004, U.S. Ser. No. 60/522,360, filed Sep. 20, 2004, U.S. Ser. No. 60/522,498, filed Oct. 7, 2004, U.S. Ser. No. 60/522,500, filed Oct. 7, 2004; U.S. Ser. No. 60/593,216; U.S. Ser. No. 60/593,217, and U.S. Ser. No. 60/595,138, entitled "Apparatus and Method for Continuously Injecting Fluids Safely in a Wellbore" filed on Jun. 8, 2005.

Subsurface safety valve 122 can act to shut off flow through production tubing 110 below wellhead 114 either automatically or at the direction of an operator at the surface. Regardless of the reason, shutting off production flow at subsurface safety valve 122 below wellhead 114 offers an added layer of protection against blowouts than operators would obtain by merely shutting off the well with valves (120, 136) at wellhead 114.

Subsurface safety valve 122, which is illustrated as an anchor seal assembly type of SSV, can be deployed to hydraulic nipple 124 within production tubing string 110 upon the distal end of upper injection conduit 126. Upper injection conduit 126 is preferably a hydraulic capillary tube, but any communication conduit, including, but not limited to, wireline, slickline, fiber-optic, or coiled tubing can be used. Upper injection conduit 126 as shown in FIG. 1 is a hydraulic conduit and is capable of injecting fluids below anchor seal assembly 122. A fluid pathway (not shown) within anchor seal assembly 122 connects upper injection conduit 126 with lower injection conduit 128 to allow fluid injection below anchor seal assembly 122 independent of the orientation of any flow control member of the anchor seal assembly 122 subsurface safety valve. One or more check valves 129 in injection conduits (126, 128) prevent fluids from flowing from the production zone to the surface through the injection conduits (126, 128). Alternatively, two-way communication can be provided through the injection conduits (126, 128) by removing the check valve 129 as desired for particular applications.

Injection head 130, located at a distal end of lower injection conduit 128, allows for the release of injected fluids 132 into the reservoir 102. Injected fluids 132 can be any liquid, foam, or gaseous formula that is desirable to inject into a reservoir or downhole tubing. Surfactants, acids, corrosion inhibitors, scale inhibitors, hydrate inhibitors, paraffin inhibitors, and miscellar solutions can be used as injected fluids 132. Injected fluids 132 can be injected at the surface by injection pump 134 through upper injection conduit 126 which enters production tubing string 110 through replacement bypass valve 136, here a lower or "master" valve as provided by the present invention. The flow of injected fluids 132 can be controlled by flow control valve 138, which can be a valve as sold under the trademark MERLA, for example.

Production fluids 140 can enter production tubing string 110 at perforations 108, flow past anchor seal assembly 122, which can include a subsurface safety valve, and flow to the surface through a sealed opening in wellhead 114. When it is desired to shut down the well, subsurface safety valve of anchor seal assembly 122 and/or replacement bypass master valve 136 can be closed, preventing flow of production fluids 140 from progressing to the surface. With replacement bypass master valve 136 and/or subsurface safety valve of anchor seal assembly 122 closed, the injection of injected fluids 132 is still feasible through injection conduits (126, 128). Injected fluids 132 can enable a surface operator to perform work to stimulate or otherwise work over the reservoir 102 or downhole components while flow control member of anchor seal assembly 122 or replacement bypass master valve 136 is closed.

Figure 2:
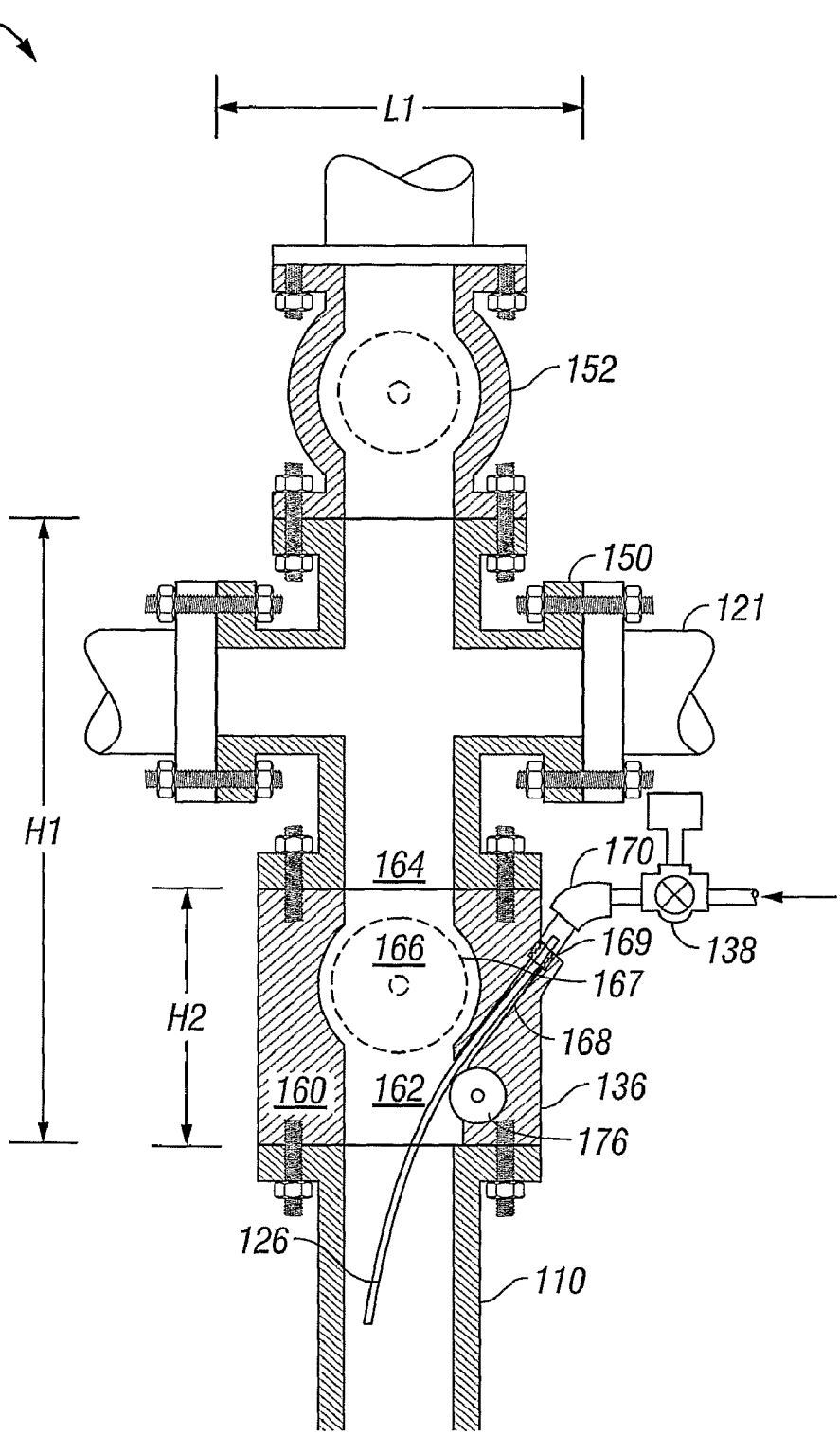
FIG. 2 is a schematic illustration of a wellhead Christmas tree incorporating one embodiment of the present invention.

FIG. 2 schematically illustrates a wellhead 114 in more detail. Wellhead 114 can have multiple inlets and outlets, commonly referred to as a Christmas-tree, and illustrated as cross 150. Valves 120 (not shown in FIG. 2) and/or flowline 121 can be attached to cross 150, as is illustrated in FIG. 1, or valve 152 can be attached to cross 150 as illustrated in FIG. 2. Bypass master valve 136 can be the primary shut-off valve for the well system.

Replacement bypass master valve 136 can attach production tubing 110 to cross 150. Replacement bypass master valve 136 can be used when constructing a new well, or can be used to replace an existing master valve. When used to replace an existing master valve, replacement bypass master valve 136 can have the same geometric dimensions as the original master valve and/or cross 150, for example, height (H1 or H2) and width (L1), thus minimizing the changes to the wellhead 114 when adapting the wellhead 114 to use replacement bypass master valve 136. Although illustrated as the master valve, the bypass pathway 168 can be utilized with any valve of a wellhead 114 without departing from the spirit of the invention.

Figure 3:
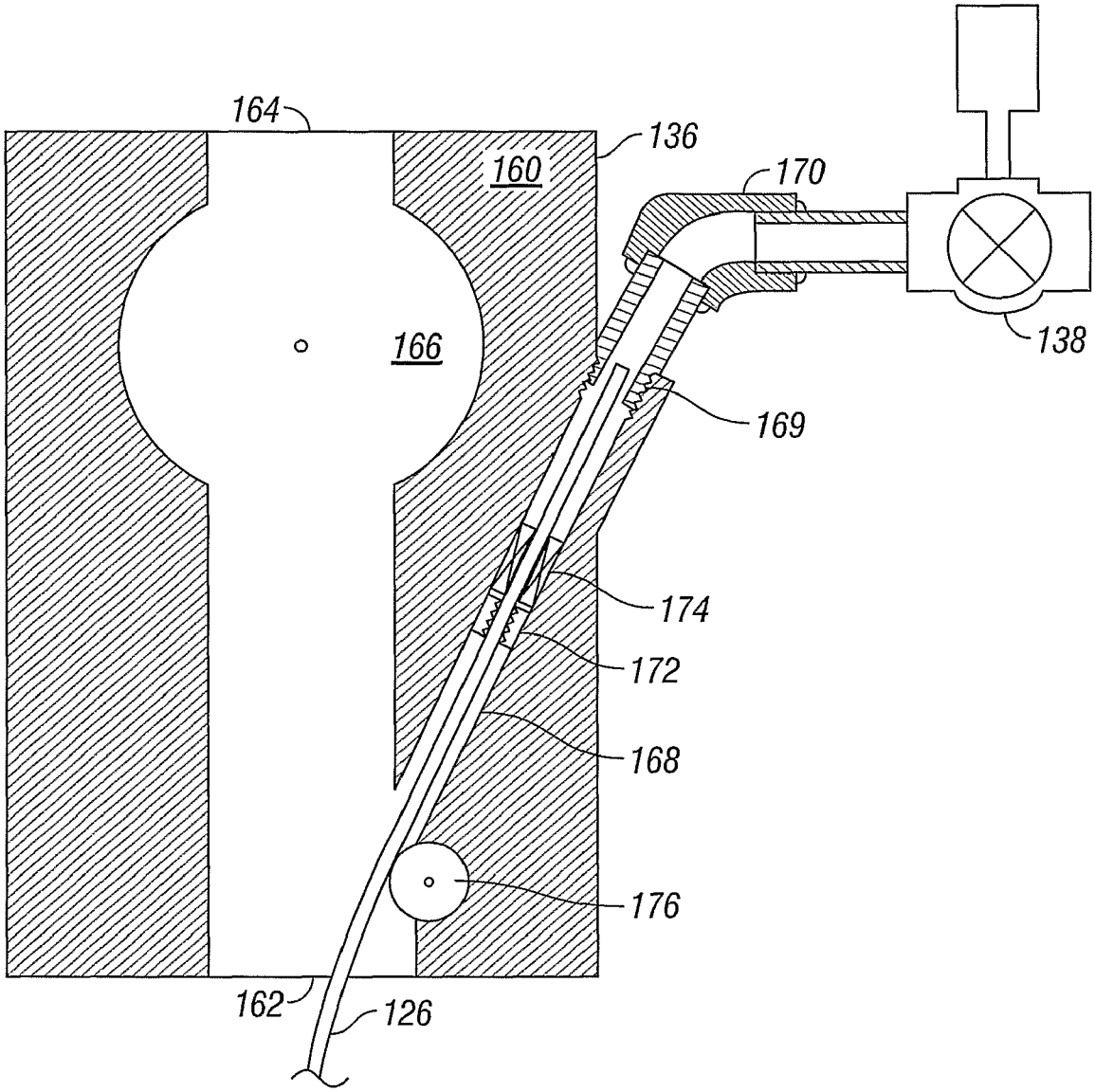
FIG. 3 is a sectional view of one embodiment of the valve of the present invention.

Referring now to FIGS. 2 and 3, replacement bypass master valve 136 has a valve body 160 having an upstream inlet bore 162, a downstream outlet bore 164, and an interior chamber 166. Interior chamber 166, as illustrated, can house a flow control member 167 to control the flow of production fluids 140 through replacement bypass master valve 136. The flow control member 167 is shown schematically as a disk (dotted), but can be a ball, gate, piston/needle, or other flow control members used to control flow through valves, as is know to one of ordinary skill in the art.

Figure 4:
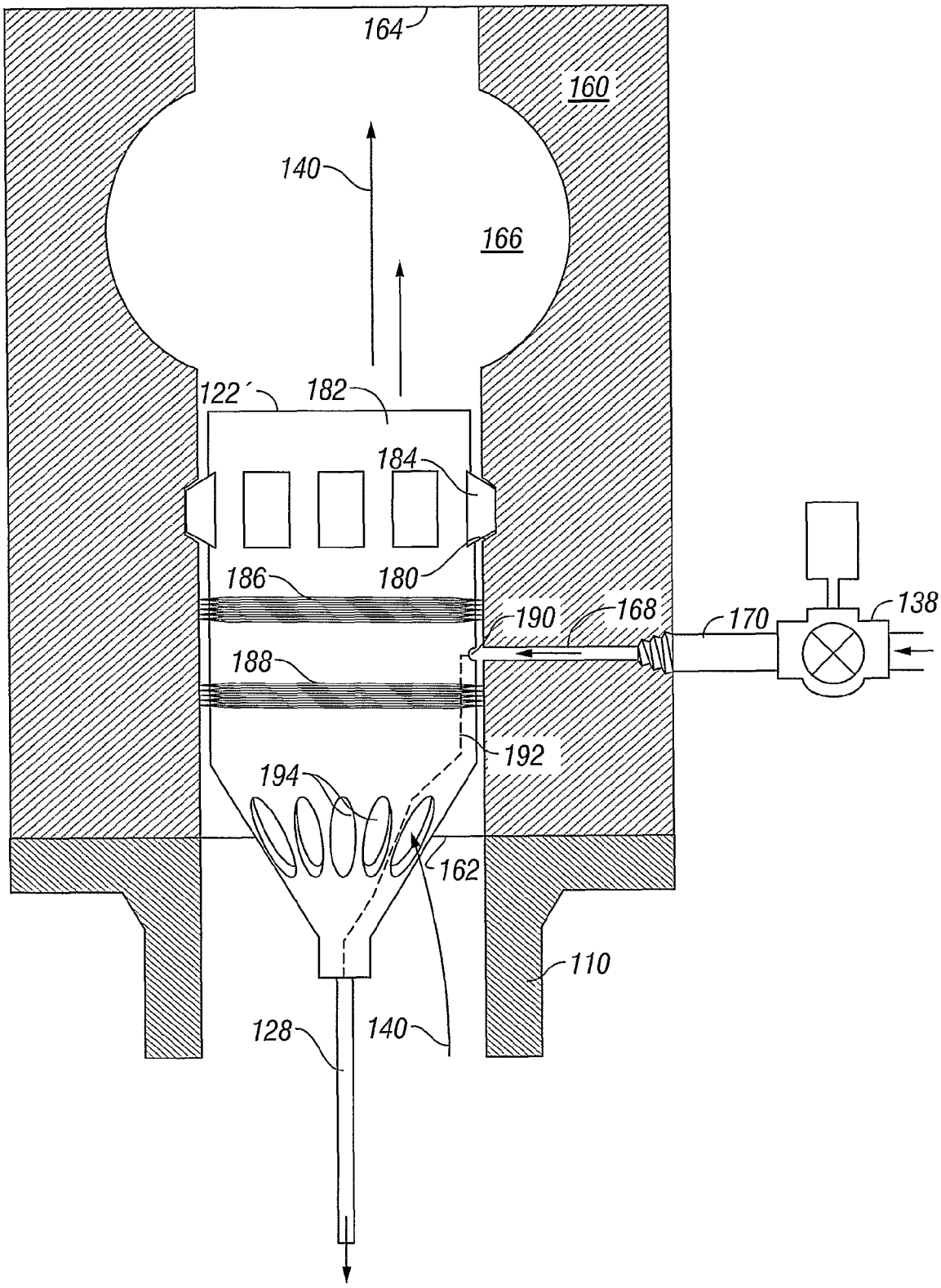
FIG. 4 is a sectional view of another embodiment of the valve of the present invention with an anchor seal assembly disposed therein.

Fluid bypass pathway 168 provides a second fluidic pathway from upstream inlet bore 162 to the exterior of the valve body 160. Fluid bypass pathway 168 can be oblique with respect to upstream inlet bore 162, as illustrated in FIG. 2, or can be perpendicular to upstream inlet bore 162, as illustrated in FIG. 4. The port 169 of fluid bypass pathway 168 in the valve body 160 can be a threaded connection (as in FIG. 3, for example) or a flanged connection.

Although replacement bypass master valve 136 is illustrated and described with respect to a master valve, a replacement bypass valve 136 can also be utilized in any other location on wellhead 114, so long as the fluid bypass pathway 168 is in communication with the production tubing 110 to enable injection and conveyance of fluid downhole independent of the position of any wellhead 114 valve.

In operation, capillary tubing 126 passes through fluid bypass pathway 168 and upstream inlet bore 162 and into production tubing 110 downhole. Connections 170 can be attached to valve body 160 at the port 169 of fluid bypass pathway 168 to provide fluid communication from injection pump 134 and metering or flow control valve 138. Slips 172 and/or packoff 174 (see FIG. 3) can provide support for capillary tubing 126 and direct the flow of injected fluid 132 through the interior of capillary tubing 126 so as not to discharge from port 169.

As illustrated in FIG. 3, a tubing guide 176 located proximate the intersection of the upstream inlet bore 162 and the oblique or angularly disposed fluid bypass pathway 168 can be provided to facilitate the installation of capillary tubing 126 through replacement bypass master valve 136 and into the annulus of production tubing 110.

FIG. 4 illustrates another embodiment of the replacement bypass master valve 136' of the present invention. An upper portion of upstream inlet bore 162 of replacement bypass master valve 136' can have a locking profile 180 for the attachment of a subsurface safety valve or anchor seal assembly 122'. Anchor seal assembly 122', differing from the anchor seal assembly 122 in FIG. 1, is shown constructed as a substantially tubular main body 182 having a locking dog outer profile 184 and an upper 186 and lower 188 seal assembly, illustrated as a pair of hydraulic seal packers (186, 188). Locking dog outer profile 184 is configured to engage with and be retained by locking profile 180 of replacement bypass master valve 136'. While one system for locking anchor seal assembly 122' securely within replacement bypass master valve 136' is shown schematically in FIG. 4, other mechanisms for securing anchor seal assembly 122' within replacement bypass master valve 136' are known to those of ordinary skill in the art. When installed, packer seals (186, 188) are respectively above and below fluid bypass pathway 168 to allow fluid communication with anchor seal assembly 122' through a corresponding port 190 on exterior surface of anchor seal assembly 122' main body 182, said port 190 located between packer seals (186, 188).

Anchor seal assembly 122' is preferably deployed to replacement bypass master valve 136' after being connected to the proximal end of a lower injection conduit 128. Communication channel 192 within main body 182 connects fluid bypass pathway 168 with lower injection conduit 128 below main body 182. Communication channel 192 enables an operator at the surface to hydraulically communicate with the zone below anchor seal assembly 122' regardless of whether production flow apertures 194 are in the open or closed position. The replacement bypass master valve 136' illustrated in FIG. 4 is advantageously employed during the construction of new wells, thereby eliminating the need to install hydraulic nipples (e.g., hydraulic nipple 124 in FIG. 1) within the production tubing string 110 for the installation of anchor seal assemblies, which can be used for fluidic injection, and/or subsurface safety valves.

Figure 5:
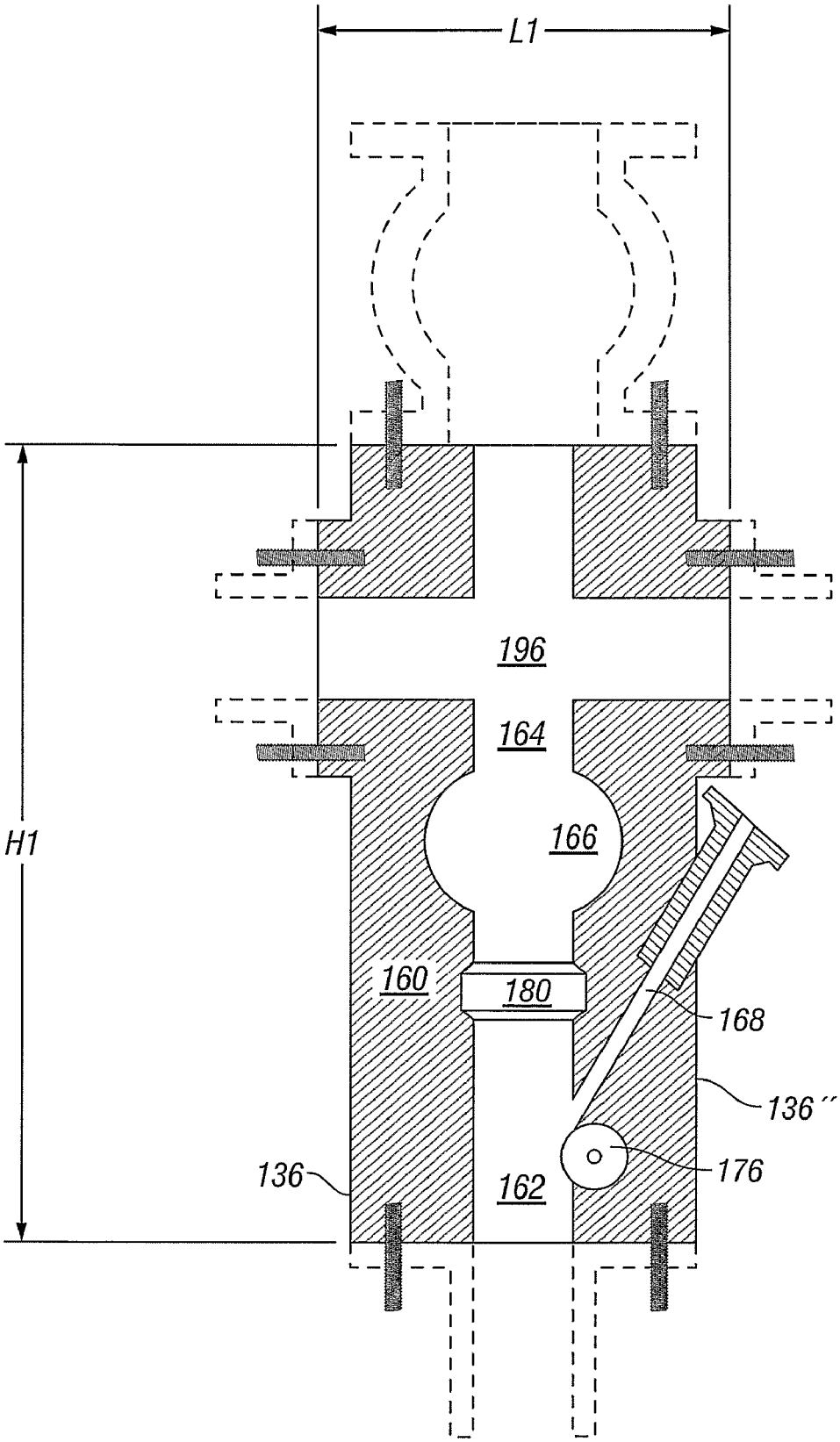
FIG. 5 is a sectional view of another embodiment of the valve of the present invention incorporating a flow cross into the valve body.

FIG. 5 illustrates yet another embodiment of the replacement bypass master valve 136" of the present invention. Replacement bypass master valve 136" can incorporate an integral flow cross 196 at an upper end of downstream outlet bore 164. As illustrated, the replacement bypass master valve 136" of FIG. 5 has an integral tubing guide 176, a fluid bypass pathway 168, and a locking profile 180 adapted to receive a ported tubing hanger, anchor seal assembly, or a subsurface safety valve. It should be noted that the angle of the fluid bypass pathway 168 can be placed at any angle that is operationally desirable. A fluid bypass pathway 168 that is perpendicular to upstream inlet bore 162 is within the scope of the present invention.

Figure 6:
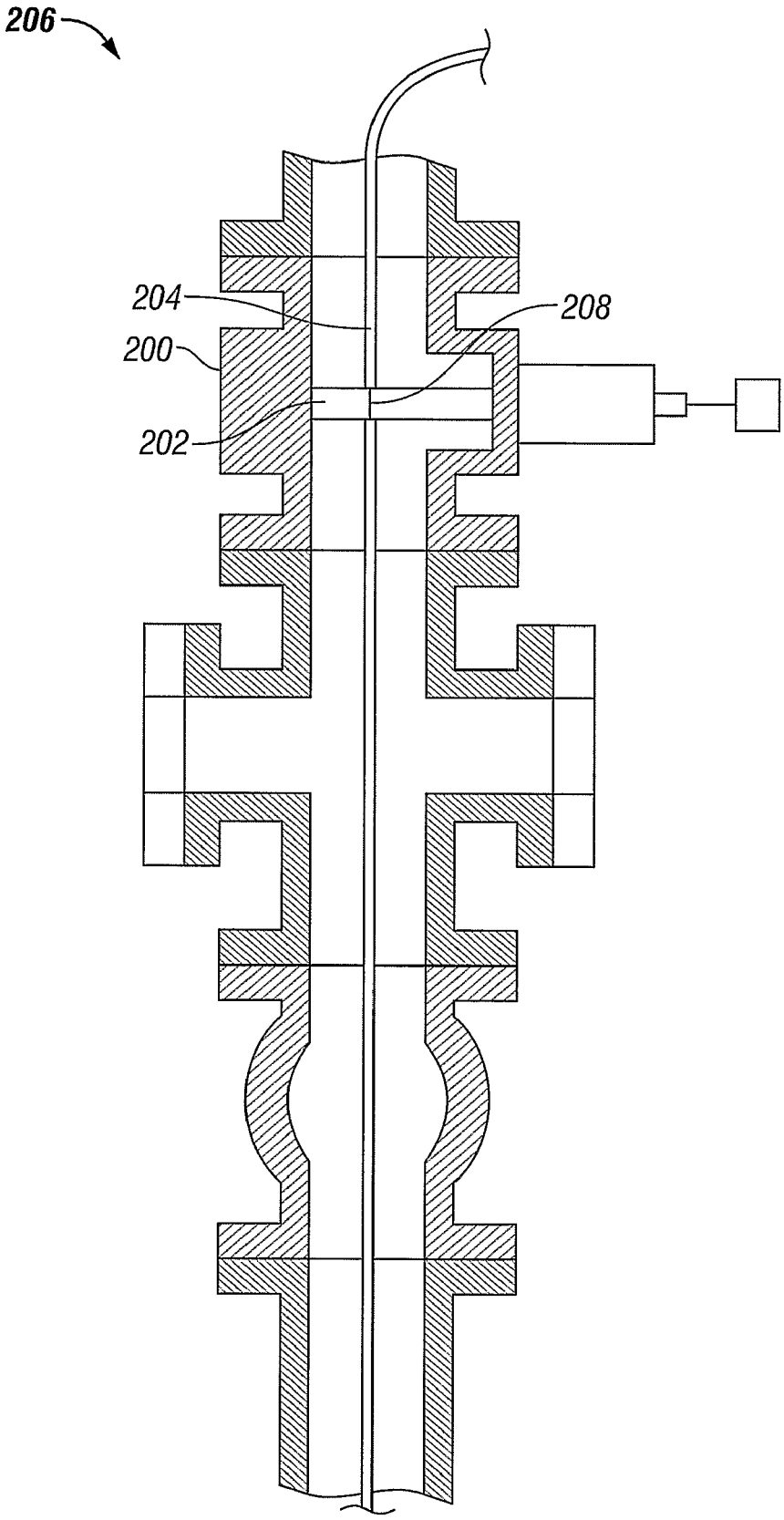
FIG. 6 is a sectional view of another embodiment of a valve of the present invention wherein the gate of the valve forms a seal around the capillary tubing.

FIG. 6 illustrates a replacement bypass valve 200 incorporating a gate design of flow control member. Gate 202 is adapted to close and seal around the capillary tubing 204, allowing deployment of the capillary tubing out the top of the wellhead Christmas tree 206 as is typical in the art. This design employs a groove or a notch 208 in the gate 202 of the replacement gate valve 200 specifically adapted to substantially surround the capillary tubing 204 and seal around it. Groove 208 enables opening and closing of the gate 202 of replacement valve 200 to seal the wellhead 206 without disrupting the function of the capillary tubing 204 or flow of fluids therethrough.

In operation, this system is ideally adapted for remediation of problems on existing wells. The invention as described above in relation to the figures can be used in new construction or can be used to retrofit a producing well. The steps to retrofit an existing well with the replacement bypass master valve 136 of the present invention, such as the master valve illustrated in FIG. 2 for example, include removing a master valve having given axial dimensions from a wellhead 114 (e.g., Christmas tree), replacing said flow control valve with a replacement bypass master valve 136 of similar dimensions, for example, bore diameter, width axial length, and any connections. The retrofit is facilitated by utilizing a replacement bypass master valve 136 having similar dimensions to that of the valve being removed, thereby eliminating the need to re-pipe existing wellhead connections.

A well can also be retrofitted with a valve, similar to that as illustrated in FIG. 5. The replacement bypass master valve 136" having an integrated cross can replace both the master valve and the flow cross of an existing wellhead. In this embodiment, the dimensions of the integrated replacement valve can be similar to that of the combined master valve and flow cross. Use of an integrated valve minimizes the number of connections and potential leak points in addition to negating the need to re-pipe the wellhead connections to accommodate a valve of varying dimensions.

The invention also allows the well to be facilitated into operation after retrofitting by inserting a small diameter tubing string 126 through said fluid bypass pathway 168 into a production tubing and injecting a production enhancing fluid into the reservoir independent of the position of any flow control member of said replacement valve. To facilitate the retrofit, a subsurface safety valve can be employed to temporarily stop well production.

The present invention also provides a method of producing a well including installing a valve 200 having a gate 208 adapted to mate with a second non-motive gate 202 to seal around a small diameter tubing 204 while in the closed position in a wellhead Christmas tree, inserting the small diameter tubing string 204 into a production tubing, and injecting a production enhancing fluid through the small diameter tubing 204 into the wellbore. Gate 208 preferably has a groove in the leading edge thereof to receive the small diameter tubing string 204. When in a closed position, the interaction of gate 208 and non-motive gate 202 seals the bore while allowing passage of small diameter tubing 204. Further, gate 208 and non-motive gate 202 can both contain a groove, for example, that cooperate to seal around small diameter tubing string 204.

All patent documents referred to herein are hereby incorporated by reference in their entirety for purposes of U.S. patent practice and other jurisdictions where permitted.

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims.

We claim:

1. An apparatus for use in a production well having a wellhead attached to a production tubing, comprising:

a body member having an upstream inlet bore, a downstream outlet bore, and an interior chamber;

a flow control member disposed in the interior chamber to regulate a fluid flow from the upstream inlet bore to the downstream outlet bore;

a fluid bypass pathway connecting the upstream inlet bore upstream each of any flow control member of the wellhead to a port in the body member to allow fluid communication with the production tubing independent of a position of the any flow control member of the wellhead;

a communication conduit having an upper end and a distal end installed through the fluid bypass pathway; and a subsurface safety valve disposed in the production tubing, the subsurface safety valve connected to the distal end of the communication conduit.

2. The apparatus of claim 1 wherein the body member further comprises an integral flow cross at an upper end of the downstream outlet bore having at least two outlets in fluid communication with the downstream outlet bore.

3. The apparatus of claim 1, wherein the fluid bypass pathway is perpendicular to the upstream inlet bore.

4. The apparatus of claim 1, wherein the fluid bypass pathway is oblique to the upstream inlet bore.

5. The apparatus of claim 1 further comprising a tubing guide proximate an intersection of the upstream inlet bore and the fluid bypass pathway.

6. The apparatus of claim 1 wherein the distal end of the communication conduit extends into the production tubing.

7. The apparatus of claim 1 further comprising at least one slip between an interior of the fluid bypass pathway and an exterior of the communication conduit.

8. The apparatus of claim 1 comprising a packoff proximate an upper end of the fluid bypass pathway; the packoff sealing an annulus between an interior of the fluid bypass pathway and an exterior of the communication conduit.

9. The apparatus of claim 1 wherein the communication conduit is selected from the group consisting of capillary tubing, wireline, slickline, fiber optic cable, and coiled tubing.

10. The apparatus of claim 1 comprising a tool connected to the distal end of the communication conduit.

11. The apparatus of claim 10 further comprising a lower communication conduit extending upstream from the subsurface safety valve, the lower communication conduit in fluid communication with the communication conduit through an interior passage of the subsurface safety valve.

12. The apparatus of claim 11 further comprising an injection head connected to a distal end of the lower communication conduit.

13. A master valve of a wellhead attached to a production tubing comprising:

a master valve body having an upstream inlet bore, a downstream outlet bore, and an interior chamber;

a flow control member disposed in the interior chamber to regulate a fluid flow from the upstream inlet bore to the downstream outlet bore;

a fluid bypass pathway connecting the upstream inlet bore to a port in the master valve body a communication conduit having an upper end and a distal end installed through the fluid bypass pathway; and a subsurface safety valve disposed in the production tubing, the subsurface safety valve connected to the distal end of the communication conduit.

14. The master valve of claim 13 wherein the communication conduit is capillary tubing.

15. The master valve of claim 13 wherein the fluid bypass pathway is capillary tubing.

16. A method to retrofit a wellhead comprising an original master valve having an axial length, a width, and an internal bore diameter, the method comprising:

removing the original master valve;

providing a bypass master valve having a substantially similar axial length, width, and internal bore diameter as the original master valve;

replacing the original master valve with the bypass master valve, the bypass master valve comprising a master valve body having an upstream inlet bore, a downstream outlet bore, and an interior chamber, a flow control member disposed in the interior chamber to regulate a fluid flow from the upstream inlet bore to the downstream outlet bore, and a fluid bypass pathway connecting the upstream inlet bore to a port in the master valve body.

17. The method of claim 16 wherein the fluid bypass pathway connects to the upstream inlet bore upstream each of any flow control member of the wellhead.

18. The method of claim 16 further comprising fluidicly communicating with a production tubing attached upstream to the master valve through the fluid bypass pathway when the flow control member is closed.

19. The method of claim 16 further comprising:

inserting an anchor seal assembly into a locking profile in the upstream inlet bore of the bypass master valve; and sealing the anchor seal assembly to the upstream inlet bore with an upper seal assembly and a lower seal assembly, an inlet port in the main body intermediate the upper and lower seal assemblies in fluid communication with the fluid bypass pathway and a communication channel in fluid communication with the inlet port and an outlet port on a lower end of the anchor seal assembly.

20. An apparatus for use in a production well having a wellhead attached to a production tubing, comprising:

a body member having an upstream inlet bore, a downstream outlet bore, and an interior chamber;

a flow control member disposed in the interior chamber to regulate a fluid flow from the upstream inlet bore to the downstream outlet bore; and a fluid bypass pathway connecting the upstream inlet bore upstream each of any flow control member of the wellhead to a port in the body member to allow fluid communication with the production tubing independent of a position of the any flow control member of the wellhead, wherein the upstream inlet bore further comprises a locking profile intermediate the interior chamber and the fluid bypass pathway.

21. The apparatus of claim 20 further comprising an anchor seal assembly comprising:

a main body providing an engagement profile configured to be retained by the locking profile;

an upper seal assembly and a lower seal assembly to seal an interface between the main body and the upstream inlet bore;

an inlet port in the main body intermediate the upper and lower seal assemblies in fluid communication with the fluid bypass pathway;

an outlet port in the main body proximate a lower end of the main body; and a communication channel extending through the main body to provide fluid communication between the inlet port and the outlet port.

22. The apparatus of claim 21 further comprising a lower communication conduit in fluid communication with the outlet port.

23. The apparatus of claim 22 further comprising an injection head connected to a distal end of the lower communication conduit.

* * * * *

UNITED STATES PATENT AND TRADEMARK OFFICE

CERTIFICATE OF CORRECTION

PATENT NO. : 7,770,653 B2
APPLICATION NO. : 11/916985
DATED : August 10, 2010
INVENTOR(S) : Hill et al.

It is certified that error appears in the above-identified patent and that said Letters Patent is hereby corrected as shown below:

Title Pg, Item (54) Title: should read:

-- (54) WELLHEAD BYPASS METHOD AND APPARATUS --.

Col. 1, Line 1, should read as follows:

--WELLHEAD BYPASS METHOD AND APPARATUS --.

Signed and Sealed this

Nineteenth Day of October, 2010

David J. Kappos

David J. Kappos
*Director of the United States Patent and Trademark Office*